US005893178A

United States Patent [19]

Wosiek

[11] Patent Number: 5,893,178

[45] Date of Patent: Apr. 13, 1999

[54] MUSICAL POTTY TRAINER

[76] Inventor: Zofia Wosiek, 5559 W. Leland Ave., Chicago, Ill. 60630

[21] Appl. No.: 08/940,500

[22] Filed: Sep. 30, 1997

[51] Int. Cl.[6] ..... A47K 11/04

[52] U.S. Cl. ..... 4/483; 4/902

[58] Field of Search ..... 4/483, 661, 902, 4/476

[56] References Cited

U.S. PATENT DOCUMENTS

| | | | |
|---|---|---|---|
| 2,153,866 | 4/1939 | Hess | 4/476 |
| 2,245,204 | 6/1941 | La Plante | 4/483 |
| 3,680,151 | 8/1972 | Boardman et al. | 4/483 X |
| 4,161,793 | 7/1979 | Merchan | 4/476 |
| 5,008,964 | 4/1991 | Dean et al. | 4/661 |
| 5,369,820 | 12/1994 | Blount | 4/902 X |
| 5,560,051 | 10/1996 | Butts | 4/902 X |
| 5,652,975 | 8/1997 | Hoskin | 4/902 X |

FOREIGN PATENT DOCUMENTS

| | | | |
|---|---|---|---|
| 8400591 | 9/1985 | Netherlands | 4/902 |
| 0697912 | 9/1953 | United Kingdom | 4/661 |

*Primary Examiner*—Charles E. Phillips

[57] ABSTRACT

A musical potty seat is provided including a potty for containing waste fluid from a child situated thereover. Next provided is a sound mechanism having a heat sensing mechanism in communication with the potty when in use for generating an activation signal upon the detection of a temperature greater than a predetermined amount and a sound device adapted to generate music upon the receipt of the activation signal.

1 Claim, 2 Drawing Sheets

MUSICAL POTTY TRAINER

BACKGROUND OF THE INVENTION

1. Field of the Invention

The present invention relates to talking potty seats and more particularly pertains to a new musical potty trainer for producing a musical tune when heat from waste is detected in a potty.

2. Description of the Prior Art

The use of talking potty seats is known in the prior art. More specifically, talking potty seats heretofore devised and utilized are known to consist basically of familiar, expected and obvious structural configurations, notwithstanding the myriad of designs encompassed by the crowded prior art which have been developed for the fulfillment of countless objectives and requirements.

Known prior art talking potty seats include U.S. Pat. No. 5,008,964; U.S. Pat. No. 4,757,542; U.S. Pat. Des. 356,633; U.S. Pat. No. 5,432,956; U.S. Pat. No. 4,883,749; and U.S. Pat. No. 4,539,559.

In these respects, the musical potty trainer according to the present invention substantially departs from the conventional concepts and designs of the prior art, and in so doing provides an apparatus primarily developed for the purpose of producing a musical tune when heat from waste is detected in a potty.

SUMMARY OF THE INVENTION

In view of the foregoing disadvantages inherent in the known types of talking potty seats now present in the prior art, the present invention provides a new musical potty trainer construction wherein the same can be utilized for producing a musical tune when heat from waste is detected in a potty.

The general purpose of the present invention, which will be described subsequently in greater detail, is to provide a new musical potty trainer apparatus and method which has many of the advantages of the talking potty seats mentioned heretofore and many novel features that result in a new musical potty trainer which is not anticipated, rendered obvious, suggested, or even implied by any of the prior art talking potty seats, either alone or in any combination thereof.

To attain this, the present invention generally comprises a unitary chair having a U-shaped horizontal cross-section along an entire height thereof. Note FIG. 2. The chair thus defines an interior space which is accessible from a front and top thereof. A pair of extensions are integrally formed on a rear of the chair adjacent to sides thereof. Such extensions are triangular shaped and extend rearwardly and downwardly from the chair for engaging a floor to prevent the chair from toppling. The chair is further equipped with a horizontally oriented platform integrally coupled to a central extent of the interior space of the chair for supporting a sitting child. The platform has a circular opening for allowing fluid to pass therethrough. The chair further has a horizontally oriented shelf integrally coupled within the interior space of the chair directly below the platform. As such, a compartment is defined between the shelf and platform. For reasons that will become apparent hereinafter, a pair of L-shaped retainers are formed on a bottom of the platform on opposite sides of the opening. With reference now to FIG. 5, a removable potty is provided having a circular bottom face and a cylindrical periphery integrally formed therewith and extending upwardly therefrom for defining an interior and an open top. An annular lip is integrally coupled to a top peripheral edge of the periphery of the potty and extends radially outwardly therefrom. A vertically oriented closed loop handle is integrally coupled to an outer surface of the periphery. It should be noted that the potty has a height approximately equal to that of the compartment. By this structure, the potty may be removably inserted within the compartment with the annular lip thereof in releasable engagement with the L-shaped retainers. In its operative orientation, the potty contains waste fluid from a child situated on the platform. As shown in FIGS. 4 & 6, a disk-shaped sound mechanism is mounted on an outer surface of the bottom face of the potty. With reference now to FIG. 1, it is shown that the sound mechanism has heat sensing means for generating an activation signal upon the detection of a temperature greater than a predetermined amount. Associated therewith is a sound device adapted to generate music only during the receipt of the activation signal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new musical potty trainer apparatus and method which has many of the advantages of the talking potty seats mentioned heretofore and many novel features that result in a new musical potty trainer which is not anticipated, rendered obvious, suggested, or even implied by any of the prior art talking potty seats, either alone or in any combination thereof.

It is another object of the present invention to provide a new musical potty trainer which may be easily and efficiently manufactured and marketed.

It is a further object of the present invention to provide a new musical potty trainer which is of a durable and reliable construction.

An even further object of the present invention is to provide a new musical potty trainer which is susceptible of a low cost of manufacture with regard to both materials and labor, and which accordingly is then susceptible of low prices of sale to the consuming public, thereby making such musical potty trainer economically available to the buying public.

Still yet another object of the present invention is to provide a new musical potty trainer which provides in the apparatuses and methods of the prior art some of the advantages thereof, while simultaneously overcoming some of the disadvantages normally associated therewith.

Even still another object of the present invention is to provide a new musical potty trainer that produces a musical tune when heat from waste is detected in a potty.

Still another object of the present invention is to provide a new musical potty trainer including a potty for containing waste fluid from a child situated thercover. Next provided is a sound mechanism having a heat sensing mechanism in communication with the potty when in use for generating an activation signal upon the detection of a temperature greater than a predetermined amount and a sound device adapted to generate music upon the receipt of the activation signal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
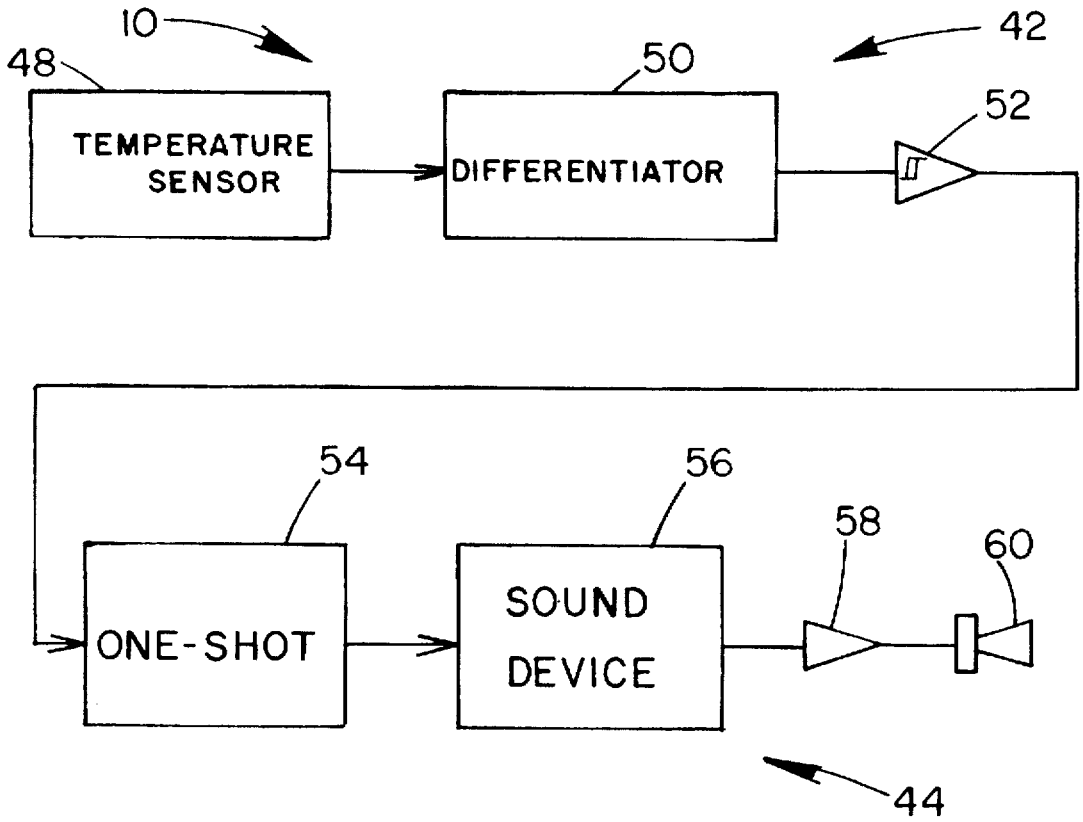
FIG. 1 is a schematic diagram of a new musical potty trainer according to the present invention.

With reference now to the drawings, and in particular to FIGS. 1 through 6 thereof, a new musical potty trainer embodying the principles and concepts of the present invention and generally designated by the reference numeral 10 will be described.

Figure 2:
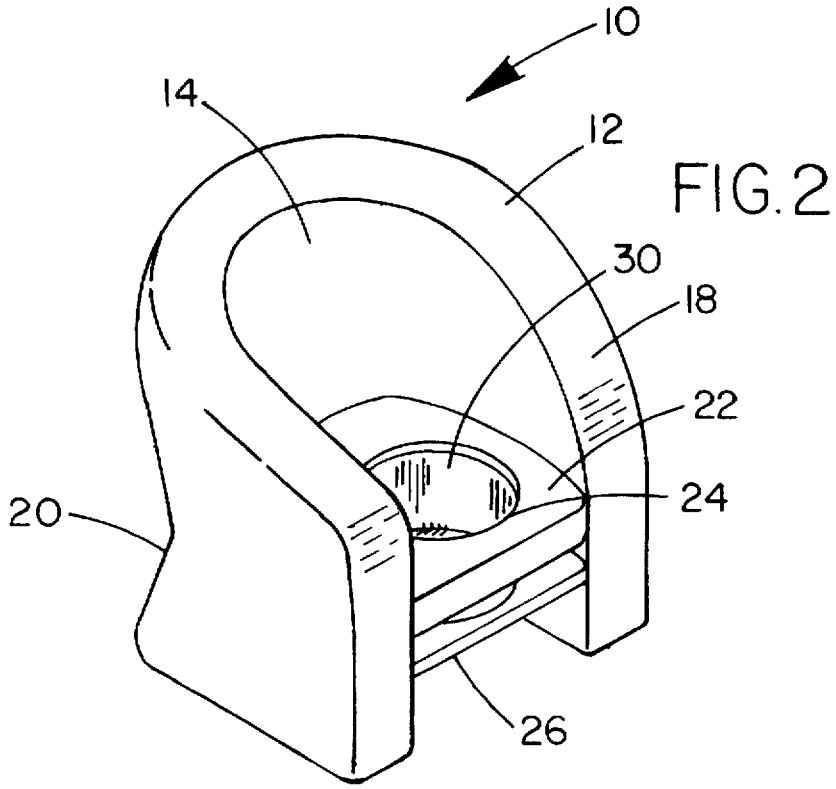
FIG. 2 is a perspective view of the present invention.
Figure 3:
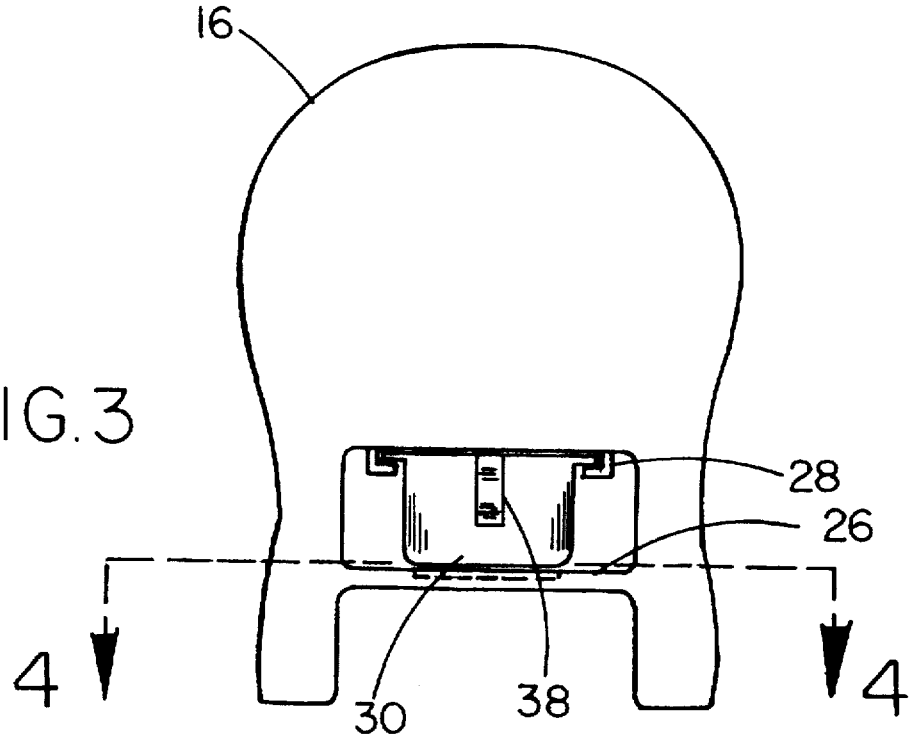
FIG. 3 is a rear view of the present invention.

The present invention, as designated as numeral 10, includes a unitary chair 12 having a U-shaped horizontal cross-section along an entire height thereof. Note FIG. 2. The chair thus defines an interior space 14 which is accessible from a front and top thereof. An upper peripheral edge of the chair has an arcuate rear extent 16 and a pair of beveled extents 18, as shown in FIGS. 2 & 3. A pair of extensions 20 are integrally formed on a rear of the chair adjacent to sides thereof. Such extensions are triangular shaped and extend rearwardly and downwardly from the chair for engaging a floor to prevent the chair from toppling.

The chair is further equipped with a horizontally oriented platform 22 integrally coupled to a central extent of the interior space of the chair for supporting a sitting child. The platform has a circular opening 24 for allowing fluid to pass therethrough. The chair further has a horizontally oriented shelf 26 integrally coupled within the interior space of the chair directly below the platform. As such, a compartment is defined between the shelf and platform. For reasons that will become apparent hereinafter, a pair of L-shaped retainers 28 are formed on a bottom of the platform on opposite sides of the opening to preclude lateral shifting of the potty.

Figure 5:
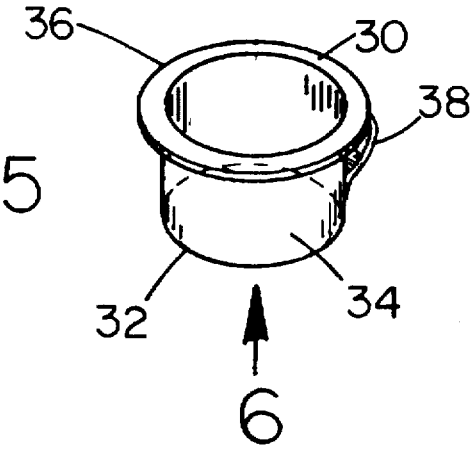
FIG. 5 is a perspective view of the potty of the present invention.

With reference now to FIG. 5, a removable potty 30 is provided having a circular bottom face 32 and a cylindrical periphery 34 integrally formed therewith and extending upwardly therefrom for defining an interior and an open top. An annular lip 36 is integrally coupled to a top peripheral edge of the periphery of the potty and extends radially outwardly therefrom. A vertically oriented closed loop handle 38 is integrally coupled to an outer surface of the periphery. The vertical nature of the handle facilitates the insertion and removal of the potty in and out of the compartment. It should be noted that the potty has a height approximately equal to that of the compartment. In the preferred embodiment, the potty is constructed from a heat conductive material such as metal.

By this structure, the potty may be removably inserted within the compartment with the annular lip thereof in releasable engagement with the L-shaped retainers. In its operative orientation, the potty contains waste fluid from a child situated on the platform.

Figure 4:
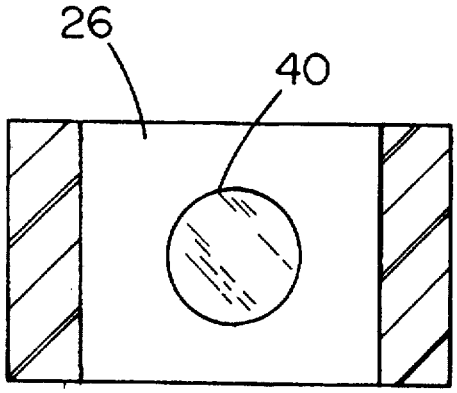
FIG. 4 is a cross-sectional view of the present invention taken along line 4—4 shown in FIG. 3.
Figure 6:
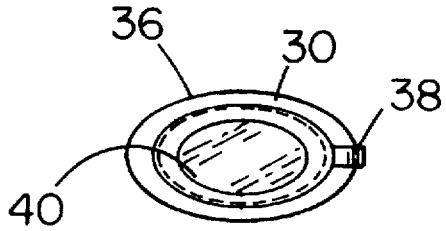
FIG. 6 is a bottom view of the potty of the present invention.

As shown in FIGS. 4 & 6, a disk-shaped sound mechanism 40 is mounted on an outer surface of the bottom face of the potty. With reference now to FIG. 1, it is shown that the sound mechanism has heat sensing means 42 for generating an activation signal upon the detection of a temperature greater than a predetermined amount. Associated therewith is a sound device 44 adapted to generate music only during the receipt of the activation signal.

To accomplish its intended function, the heat sensor means preferably comprises a temperature sensor 48 adapted to deliver a voltage commensurate with a temperature sensed. Note FIG. 1. Connected to the temperature sensor is a differentiator 50 and schmitt trigger 52 which together provide a pulse upon the temperature dependent voltage exceeding a predetermined amount. Next provided is a one-shot multivibrator 54 for generating another pulse, namely the activation signal, which continues for a predetermined duration. The sound device includes a sound generator 56 which is adapted to transmit therefrom a musical tune during the receipt of the activation signal. Associated therewith is an amplifier 58 and speaker 60 for amplifying and audibly sounding the musical tune.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A musical potty seat comprising, in combination:

a unitary chair having a U-shaped horizontal cross-section along an entire height thereof thereby defining an interior space which is accessible from a front and top thereof, a pair of extensions integrally formed on a rear of the chair adjacent to sides thereof and extending rearwardly and downwardly therefrom for engaging a floor to prevent the chair from toppling, and a horizontally oriented platform integrally coupled to a central extent of the interior space of the chair for supporting a sitting child, the platform having a circular opening for allowing fluid to pass therethrough, the chair further including a horizontally oriented shelf integrally coupled within the interior space of the chair directly below the platform thereby defining a compartment therebetween and a pair of L-shaped retainers formed on a bottom of the platform on opposite sides of the opening;

a removable potty having a circular bottom face, a cylindrical periphery integrally formed therewith and extending upwardly therefrom for defining an interior and an open top, an annular lip integrally coupled to a top peripheral edge of the periphery of the potty and extending radially outwardly therefrom, and a vertically oriented closed loop handle integrally coupled to an outer surface of the periphery, the potty having a height approximately equal to that of the compartment, whereby the potty may be removably inserted within the compartment with the annular lip thereof in releasable engagement with the L-shaped retainers thereby containing waste fluid from a child situated on the platform; and a disk-shaped sound mechanism mounted on an outer surface of the bottom face of the potty, the sound mechanism having heat sensing means for generating an activation signal upon the detection of a temperature greater than a predetermined amount and a sound device adapted to generate music only during the receipt of the activation signal.

* * * * *